US006749353B1

(12) United States Patent
Favre et al.

(10) Patent No.: US 6,749,353 B1
(45) Date of Patent: Jun. 15, 2004

(54) OFFICE MACHINE WITH PAPER ROLL PRINTER

(75) Inventors: Patrick Favre, Paris (FR); Laurent Brac de la Perriere, Paris (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/936,256

(22) PCT Filed: Mar. 16, 2000

(86) PCT No.: PCT/FR00/00632

§ 371 (c)(1),
(2), (4) Date: Jan. 24, 2002

(87) PCT Pub. No.: WO00/54977

PCT Pub. Date: Sep. 21, 2000

(30) Foreign Application Priority Data

Mar. 16, 1999 (FR) ..... 99 03208

(51) Int. Cl.[7] ..... B41J 11/56

(52) U.S. Cl. ..... 400/680; 400/613; 400/693

(58) Field of Search ..... 400/120.01, 613, 400/613.1, 691, 692, 693, 586, 680, 689, 690

(56) References Cited

U.S. PATENT DOCUMENTS

| | | | | | |
|---|---|---|---|---|---|
| 4,868,676 | A | * | 9/1989 | Matsuura et al. | 358/296 |
| 5,020,926 | A | * | 6/1991 | Wilhelm | 400/54 |
| 5,230,576 | A | * | 7/1993 | Sone | 400/649 |
| 5,411,342 | A | * | 5/1995 | Horie et al. | 400/613 |
| 5,816,718 | A | * | 10/1998 | Poole | 400/88 |
| 6,092,945 | A | * | 7/2000 | Takami et al. | 400/613 |
| 6,183,153 | B1 | * | 2/2001 | Kamoda et al. | 400/613 |
| 6,261,013 | B1 | * | 7/2001 | Bryer et al. | 400/613 |

* cited by examiner

*Primary Examiner*—Ren Yan
(74) *Attorney, Agent, or Firm*—Quarles & Brady LLP

(57) ABSTRACT

The office machine comprises a paper roll printer within a chassis (1), with a housing (10) for the paper roll (12), means (4) for driving the roll (12) and a lid (3), for closing the housing (10), upon which the drive means (4) are mounted.

6 Claims, 3 Drawing Sheets

OFFICE MACHINE WITH PAPER ROLL PRINTER

BACKGROUND OF THE INVENTION

The invention concerns office machines which have a printer associated with a roll of paper. Examples of this type of office machine are a fax machine or a portable payment terminal.

The roll of paper is received into a housing closed by a lid hinged on the machine chassis. When there is no more paper, the lid is opened and a replacement made.

Two types of such office machines are known.

In the first type, the motor and the control mechanism of a roller for driving the paper in front of the printing head by friction form a single-piece unit. The positioning of the paper is awkward because its leading edge has to be inserted into a slot giving access to the drive roller and to the head. It is therefore necessary to have both hands free and therefore to put the machine down, in the case of a payment terminal.

In the second type, some of the components of the mechanism are integral with the lid and, being therefore mobile, they thus offer better access for replacement of the paper in its housing and for achieving cooperation between the leading edge and the head. However, at each replacement, the re-meshing of the toothed wheels between the fixed part and the moving part of the mechanism causes those parts to wear. In addition, the mechanism is not fully protected and there is a risk of damage during handling or as a result of polluting particles getting in.

SUMMARY OF THE INVENTION

The invention is concerned with an office machine having a lid and a skirt ensuring that when the lid is in the open position for positioning a paper roll (12), the the roll is guided, when the lid is in the open position, the chassis is sealed, and when the lid is closed, the lid is being closed, the lid is cushioned.

To that end, the present invention concerns an office machine which has a paper roll printer in a chassis, with a housing for the paper roll, means of driving the roll and a lid for closing the housing, characterised by the fact that the drive means are mounted on the lid.

Thus all the moving parts for driving the paper form one unit and are therefore not very susceptible to external stresses. In addition, when the lid is in the open position, the mechanism is well removed from the printing head thus giving free access to it, so that the leading edge of the paper may easily be engaged by the head.

BRIEF DESCRIPTION OF THE DRAWINGS

The invention will be better understood with the aid of the following description of a preferred embodiment of the office machine of the invention, with reference to the appended drawing, in which.

DETAILED DESCRIPTION OF THE PREFERRED EMBODIMENTS

Figure 1:
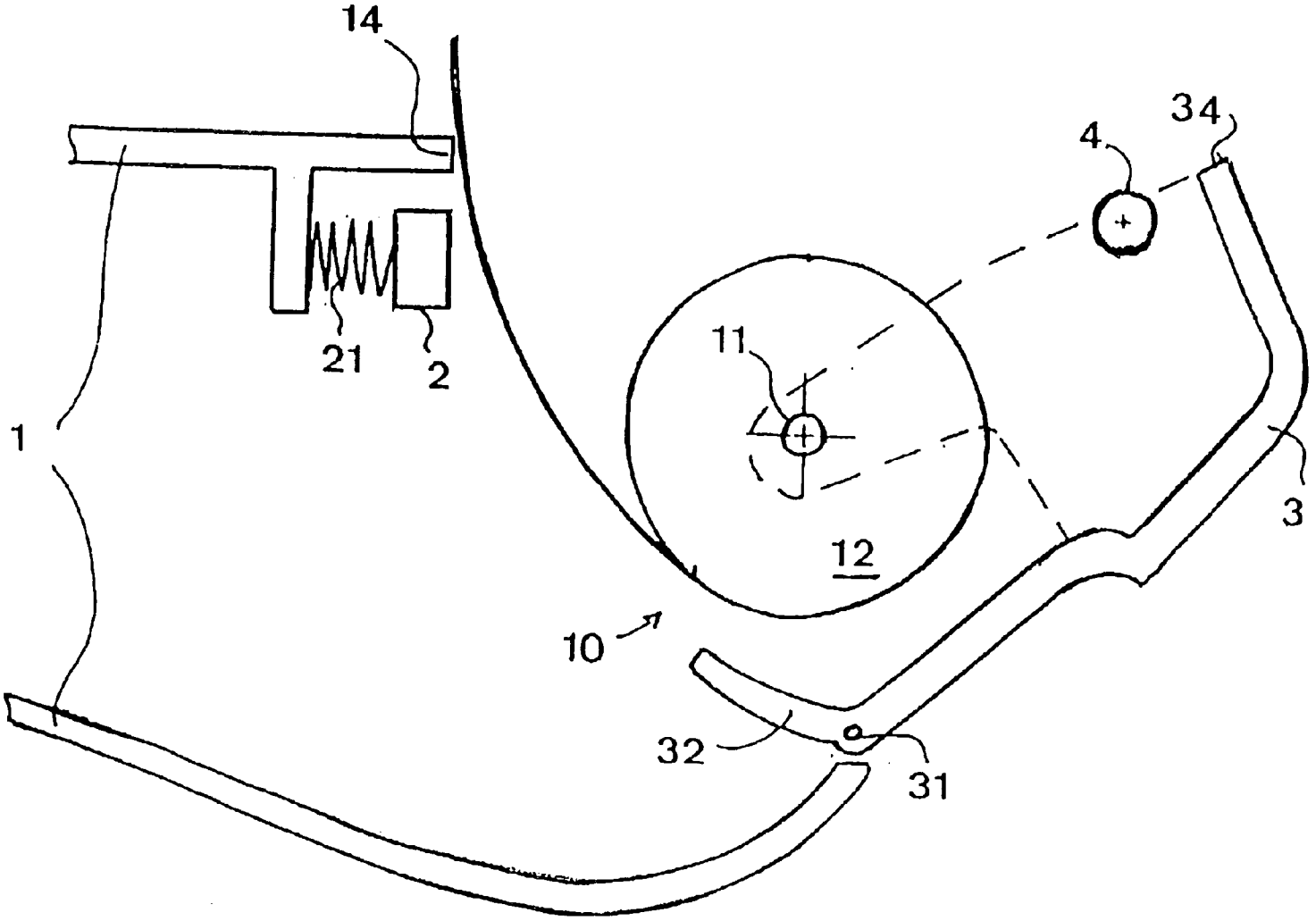
FIG. 1 is a lateral view in section representing the printing part of a portable payment terminal according to the invention, with a housing, for a roll of printing paper, and a lid which, carrying a mechanism for driving the paper, is in the open position, FIG. 2 corresponds to FIG. 1 but the terminal is here ready for printing, with the lid in the closed position.

The payment terminal partially represented in FIG. 1 has a printing head 2, mounted within a chassis 1, on a spring 21, the chassis 1 receiving a lid 3 for closing the housing 10 of a roll 12 of printing paper.

The lid 3 is mounted so that it moves upon the chassis 1, and, in this example, pivots on the latter about a theoretical axis 31, the corresponding mechanical link being constituted, at each end of the axis 31, by the nesting of male and female cylindrical parts.

In a variation, the lid 3 could be totally detachable from the chassis 1, in the manner of a refill or a removable cartridge holding paper to be used, and could be attached there by a snap-fit device with guide rails if appropriate to facilitate the positioning of the lid.

Figure 2:
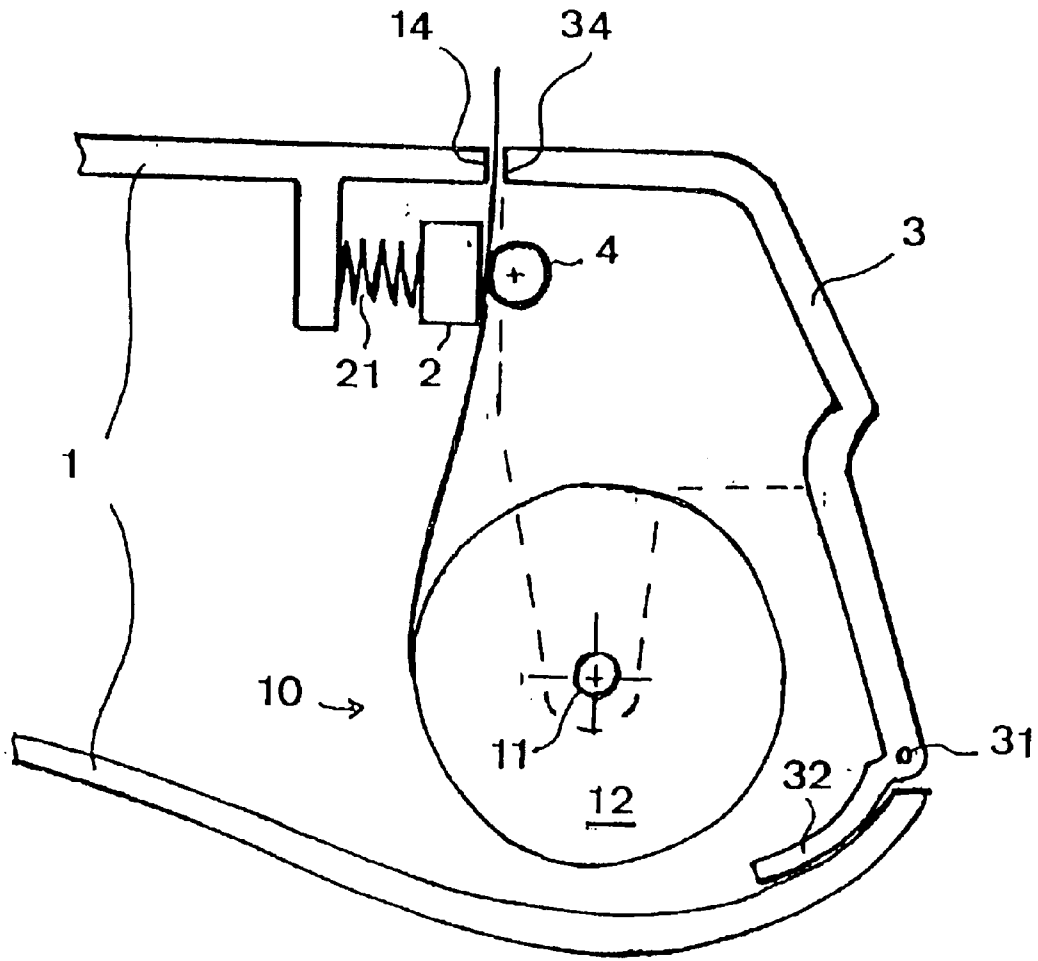

The lid 3 is integral with a mechanism for driving the paper 12 in front of the head 2, of which only one friction-drive roller 4, with counter pressure applied on the head 2, is represented in FIGS. 1 and 2. With the lid 3 in the open position, the above mechanism mounted on the lid 3 is distant from the head 1 and frees access to the housing 10 for the positioning of a replacement roll of paper 12 in it. The head 2 is then accessible, and all that is required is to pull the leading end of the roll of paper 12 and to place it in front of the head 2, against which it is then flattened by the drive roller 4 when the lid 3 is closed.

In a general way, the terminal is therefore in two parts which move one in relation to the other and are designed to house the roll of paper 12 and to permit its replacement. The lid 3 is in fact an auxiliary chassis carrying the mechanism 4, 5, 6 (FIG. 3) and which, for preference as in this case, forms a sealed wall closing the chassis 1.

FIG. 2 illustrates the operational position of the drive roller 4, forming a point of counter-pressure with the head 2 to press and drive the paper 12 by friction.

Figure 3:
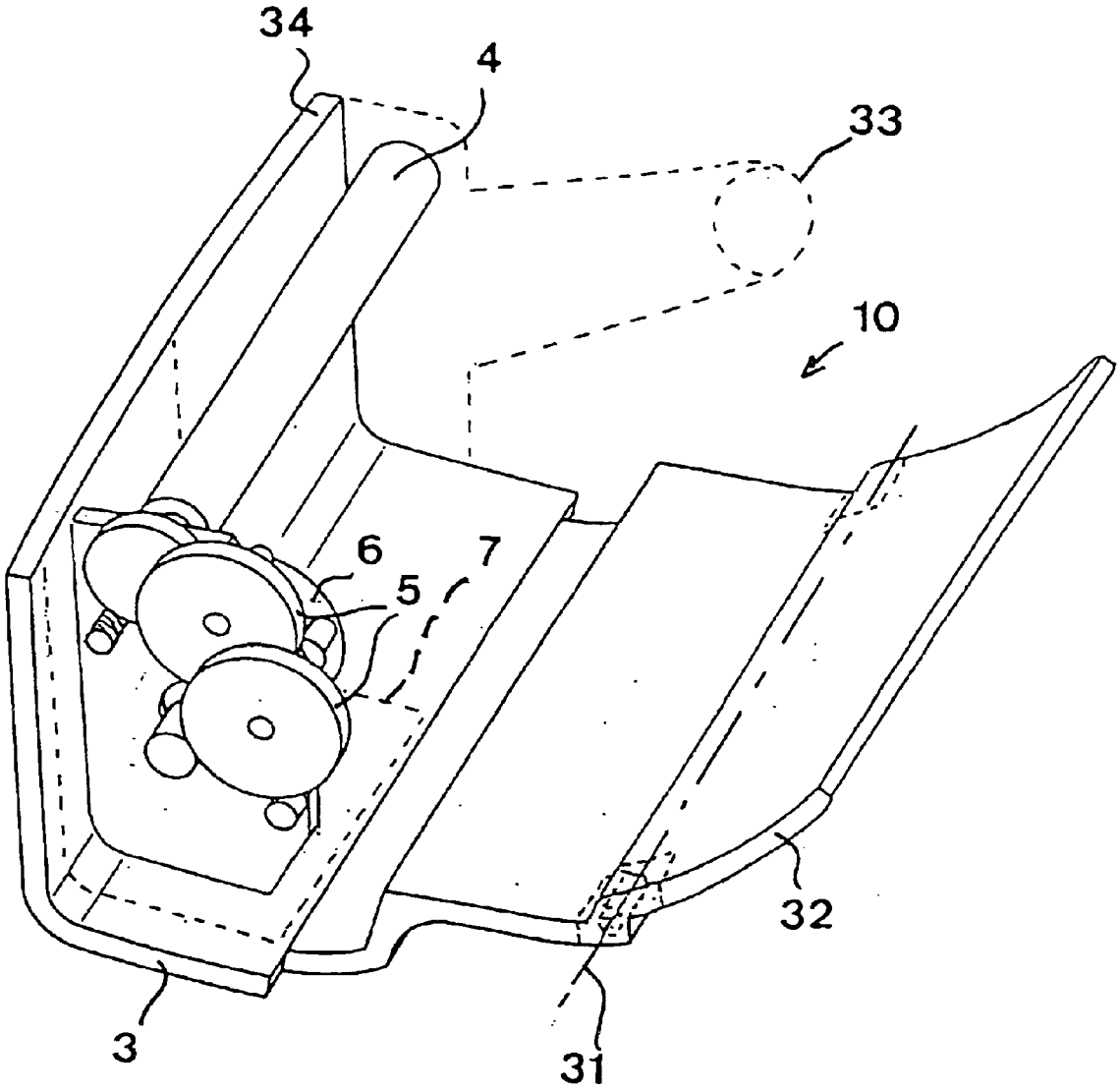
FIG. 3 is a perspective view representing the lid and the paper-driving mechanism mounted thereon.

FIG. 3 represents the drive mechanism for the paper 12, carried on the lid 3, in greater detail. It consists of a stepper motor 6 controlling a system of gears 5 the last of which causes the drive roller 4 to rotate.

In this example, the roll 12 does not rest upon the base of the housing 10 but is supported by a spindle 11 end mounted to rotate on two bearings carried by two opposed lateral flanges of the lid 3, only one of the bearings, 33, being represented.

In order best to protect the mechanism 4, 5, 6, and in particular the electrical connections of the motor 6, against the intrusion of polluting particles and against wear, the lid 3 has a skirt 32 opposed, in relation to the axis 31, to the rest of the lid 3 which carries the mechanism 4, 5, 6. As FIG. 1 shows, in the open position ready for loading, the skirt 32 projects towards the interior of the chassis 1 and occupies a position situated at the limit of the housing 10, under the paper roll 12, and serves as a support or guide facilitating the positioning of the roll 12. With the lid 3 in the closed position, the skirt 32 is closed against the inner face of the chassis 1 and thus ensures the seal of the chassis 1 in this area.

In the closed position shown in FIG. 2, the edge 34 of the lid 3 here parallel to the axis 31 and situated close to the drive roller 4 forms an abutment point resting against an opposite abutment edge 14 of the chassis 1, which regulates the relative positions of the head 2 and of the drive roller 4. This therefore regulates the cooperation between the head 2 and the roller 4 to the force or pressure required to drive the paper 12 pressed between them by friction, without slipping and without excessive constraint.

In this example, the abutment of the opposed edges 14 and 34 occurs solely at the axially opposed ends of the edges 14 and 34, that is to say that, at each end, one at least of the edges 14 and 34 has a protrusion, not drawn, which forms a spacer. The two above protrusions are axially spaced apart by a distance slightly greater than the width of the paper 12. For this reason, the central zones of the opposed edges 14 and 34 are, in the closed position, facing each other and not far apart and delineate an outlet slot for the paper 12, downstream of the printing head 2.

In order to prevent too harsh an impact of the moveable abutment edge 34 upon the fixed edge 14, an elastic shock-absorbing component may be provided such as a tongue or skirt with an elastic abutment opposing elastically the closing of the lid 3. This could be a skirt integral with the chassis 1 and against which the lid 3 or any component carried thereon would abut. In this example, the elastic skirt is however integral with the lid 3 and, specifically, consists of the sealing skirt 32, which thus serves two purposes. The elastic distortion of the skirt 32 which occurs when the lid 3 is completely closed, absorbs a surplus of kinematic energy from the closing of the lid 3 and thus limits any impact of the lid 3 upon the chassis 1. A releasable mechanism holding the lid 3 in the closed position is then provided, for example a latching device. The release of the latching device thus automatically opens the lid 3, at least partially, thanks to the energy stored in the skirt 32.

Protection of the mechanism 4, 5, 6 is furthermore ensured here by an assembly casing 7, mounted on the lid 3 and shown only by broken lines indicating where it is mounted onto the latter, the casing 7 impermeably surrounding the gears 5 and even in this case the motor 6. The drive roller 4, or at least a sensor for contact with the head 2, is however accessible.

What is claimed is:

1. Office machine which has a paper roll printer within a chassis, with a housing for the roll of paper, a lid for closing the housing, mounted so that it moves upon the chassis between an open position of the housing and a closed position of the housing, and means for driving the roll which are mounted on the lid, characterized by the fact that the lid is designed to support the roll of paper and has a skirt ensuring i) when the lid is in the open position for positioning a paper roll, the guiding of the roll, ii) when the lid is in the closed position, the sealing of the chassis, iii) when the lid is being closed, the cushioning of the lid.

2. Office machine in accordance with claim 1, in which the lid is mounted to pivot on the chassis about an axis and said skirt is opposite, in relation to the axis, to rest of the lid upon which are mounted the means for driving the roll.

3. Office machine in accordance with claim 1, in which the printer has a head, and in its closed position, the lid is designed to allow cooperation between the head of the printer and a roller for driving the paper.

4. Office machine in accordance with claim 3, in which the chassis and the lid have means of abutment to regulate pressure applied between the head and the drive roller.

5. Office machine in accordance with claim 1, in which said chassis has a wall and said skirt is an elastic skirt designed to lie flat under constraint on the wall of the chassis when the lid is in the closed position.

6. Office machine in accordance with claim 1, in which the chassis and the lid have two respective edges designed, with lid in the closed position, to delineate an outlet slot for printed paper.

* * * * *